US011437741B2

(12) United States Patent
Nakai

(10) Patent No.: US 11,437,741 B2
(45) Date of Patent: Sep. 6, 2022

(54) FASTENING STRUCTURE OF COMPLEX TERMINAL

(71) Applicant: SUMITOMO WIRING SYSTEMS, LTD., Yokkaichi (JP)

(72) Inventor: Hirokazu Nakai, Yokkaichi (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 17/058,496

(22) PCT Filed: May 17, 2019

(86) PCT No.: PCT/JP2019/019651
§ 371 (c)(1),
(2) Date: Nov. 24, 2020

(87) PCT Pub. No.: WO2019/235171
PCT Pub. Date: Dec. 12, 2019

(65) Prior Publication Data

US 2021/0203089 A1 Jul. 1, 2021

(30) Foreign Application Priority Data

Jun. 6, 2018 (JP) ..... JP2018-108609

(51) Int. Cl.
*H01R 11/26* (2006.01)
*H01R 4/02* (2006.01)
(Continued)

(52) U.S. Cl.
CPC ..... *H01R 11/26* (2013.01); *H01R 4/029* (2013.01); *H01R 43/02* (2013.01); *H01R 4/184* (2013.01)

(58) Field of Classification Search
CPC ..... H01R 43/02; H01R 4/029; H01R 4/184; H01R 11/26; H01R 11/32; B23K 2101/32; B23K 20/122
See application file for complete search history.

(56) References Cited

U.S. PATENT DOCUMENTS 6,352,193 B1 3/2002 Bellino et al.
9,065,233 B2 * 6/2015 Yabe ..... H01R 4/18
(Continued)

FOREIGN PATENT DOCUMENTS

JP 2000-158153 A 6/2000
JP 2004-195549 A 7/2004
(Continued)

OTHER PUBLICATIONS

Jun. 18, 2019 Search Report issued in International Patent Application No. PCT/JP2019/019651.

*Primary Examiner* — Briggitte R. Hammond
(74) *Attorney, Agent, or Firm* — Oliff PLC

(57) ABSTRACT

A complex terminal with a fastening structure for collectively fastening ends of a plurality of electric wires to a fastening target, the complex structure including: a plurality of couplers to which the ends of the plurality of electric wires are to be respectively coupled; a plurality of extensions respectively extending from the plurality of couplers; and a joint that is provided at a portion where end edges or side edges of the plurality of extensions are abutted against each other, and is formed by friction stir welding, wherein a fastening hole formed by a tool used in the friction stir welding is provided passing through the joint.

2 Claims, 3 Drawing Sheets

(51) Int. Cl.
*H01R 43/02* (2006.01)
*H01R 4/18* (2006.01)

(56) References Cited

U.S. PATENT DOCUMENTS

| | | | | |
|---|---|---|---|---|
| 2005/0003703 | A1* | 1/2005 | Ono | H01R 11/26 439/516 |
| 2012/0018324 | A1 | 1/2012 | Hale | |
| 2016/0250984 | A1* | 9/2016 | Gottschlich | B23K 20/10 307/10.1 |
| 2019/0084505 | A1* | 3/2019 | Ozaki | H01R 4/58 |

FOREIGN PATENT DOCUMENTS

| | | | |
|---|---|---|---|
| JP | 2009-187683 | A | 8/2009 |
| JP | 2009-199788 | A | 9/2009 |
| JP | 2012-143808 | A | 8/2012 |
| JP | 2013-208633 | A | 10/2013 |
| JP | 2015-015211 | A | 1/2015 |
| JP | 2017-016894 | A | 1/2017 |

* cited by examiner

FASTENING STRUCTURE OF COMPLEX TERMINAL

BACKGROUND

The present disclosure relates to a fastening structure of a complex terminal that collectively fastens ends of a plurality of electric wires to a fastening target.

Conventionally, for example, a structure is known in which a plurality of terminals provided at ends of a plurality of electric wires routed in an automobile or the like are collectively fastened to a ground portion of a vehicle body (for example, see JP 2017-16894A). The fastening structure described in JP 2017-16894A includes two terminals each having a bolt insertion hole. Each terminal is provided with an engaging portion, and the engaging portions of both terminals are engaged with each other to align the bolt insertion holes of the two terminals. Then, the two terminals are collectively fastened to the ground portion by a common bolt inserted through both the bolt insertion holes.

SUMMARY

In the fastening structure described in JP 2017-16894A, the two terminals are overlaid on each other in the thickness direction thereof. Therefore, the physical size of the terminal in the thickness direction is likely to increase.

An exemplary aspect of the disclosure provides a fastening structure of a complex terminal, which can suppress an increase in thickness of the complex terminal.

A complex terminal with a fastening structure according to an exemplary aspect of the disclosure for collectively fastening ends of a plurality of electric wires to a fastening target, the complex structure including: a plurality of couplers to which the ends of the plurality of electric wires are to be respectively coupled; a plurality of extensions respectively extending from the plurality of couplers; and a joint that is provided at a portion where end edges or side edges of the plurality of extensions are abutted against each other, and is formed by friction stir welding, wherein a fastening hole formed by a tool used in the friction stir welding is provided passing through the joint.

According to this configuration, the joint formed by friction stir welding is provided at the portion where the end edges or the side edges of the plurality of extensions are abutted against each other. Therefore, the thickness of the joint can be reduced as compared with, for example, a configuration in which a plurality of terminals are overlaid on each other in the thickness direction thereof. Further, since the fastening hole formed by the tool used in the friction stir welding is provided passing through the joint, a step of separately forming the fastening hole can be omitted.

For example, in a case of a configuration in which the plurality of terminals are overlaid on each other in the thickness direction and fastened to the fastening target, adhesion between the terminals is likely to be insufficient, and contact resistance between the terminals is likely to increase.

In this regard, according to the above configuration, the portion where the end edges or the side edges of the plurality of extensions are abutted against each other is plastically fluidized by a friction stir welding tool so as to be solid phase welded. Therefore, an increase in contact resistance described above can be preferably avoided.

In the above complex terminal, it is preferred that the fastening hole has an oval shape or an elliptical shape.

According to the configuration, since the fastening hole has an oval shape or an elliptical shape, manufacturing tolerances and assembly tolerances of the fastening hole and a hole of the fastening target are easily absorbed by the fastening hole, and it is easy to insert a fastening member such as a bolt into the fastening hole and the hole of the fastening target. Therefore, workability in fastening the complex terminal to the fastening target can be improved.

According to the present disclosure, an increase in thickness of the complex terminal can be suppressed.

DETAILED DESCRIPTION OF EMBODIMENTS

An embodiment will be described below with reference to FIGS. 1 to 4.

Figure 1:
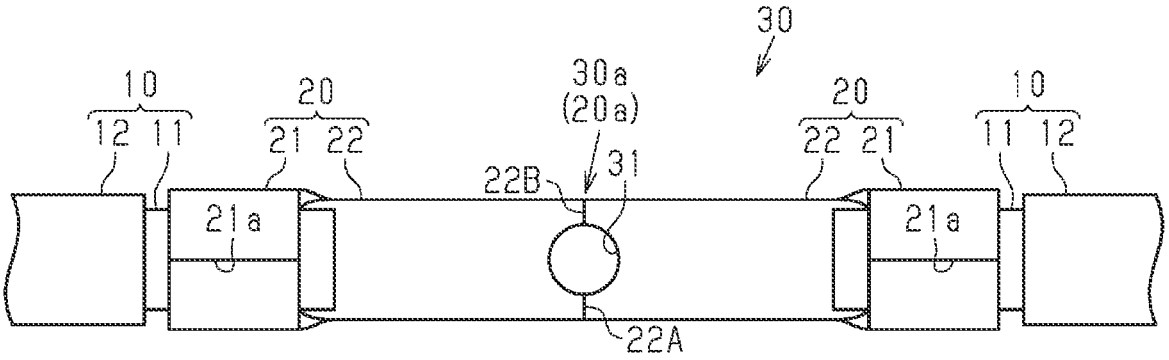
FIG. 1 is a plan view showing a complex terminal in a state where an end of an electric wire is coupled to each coupling portion in an embodiment of a fastening structure of the complex terminal.

As shown in FIG. 1, a complex terminal 30 is used when the ends of two electric wires 10 are collectively fastened to a fastening target.

Each of the electric wires 10 has a core wire 11 and a tubular insulating coating 12 that covers an outer periphery of the core wire 11. The core wire 11 includes a plurality of metal element wires, for example, made of a copper alloy. The insulating coating 12 is formed by extruding, for example, an insulating material such as polyvinyl chloride (PVC).

The complex terminal 30 has two coupling portions 21 (couplers) where the ends of the core wires 11 of the two electric wires 10 are respectively coupled, two extending portions 22 (extensions) respectively extending from the two coupling portions 21, and a joining portion 30*a* (joint) that is provided at an abutment portion 20*a* where end edges 22A and 22B of the two extending portions 22 are abutted against each other, and is formed by friction stir welding.

Each coupling portion 21 has a substantially cylindrical shape. Both coupling portions 21 are arranged on the same axis line with a space therebetween. Each coupling portion 21 has a cut 21*a* extending over the entirety in an axial direction of the coupling portion 21 in a part of the coupling portion 21 in a circumferential direction.

Each extending portion 22 has a flat plate shape, and extends in the axial direction of the coupling portion 21 from one part of the coupling portion 21 in the circumferential direction.

The coupling portion 21 and the extending portion 22 extending from the coupling portion 21 are integrally formed by pressing a metal plate material.

A circular fastening hole 31 is provided passing through the joining portion 30*a*.

Figure 4:
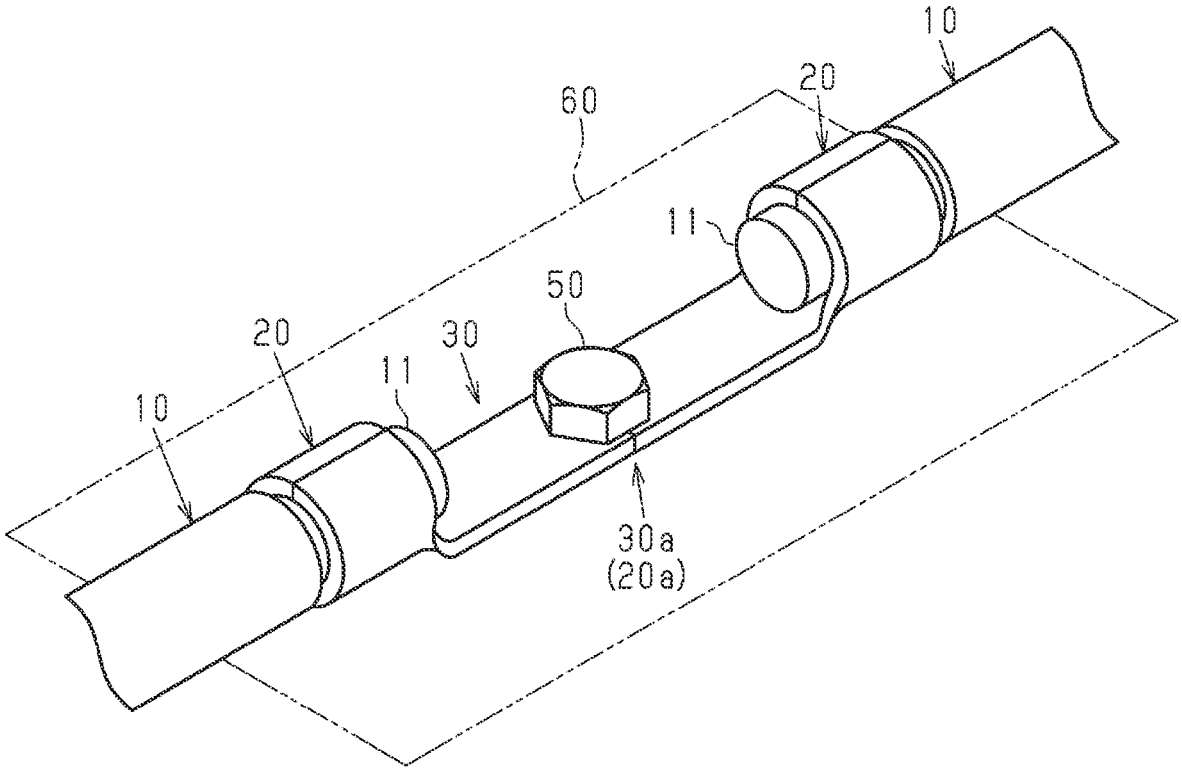
FIG. 4 is a perspective view showing a state where the complex terminal of the embodiment is fastened to a fastening target.

As shown in FIG. 1 and FIG. 4, by crimping the coupling portion 21 with the terminal of the core wire 11 of the electric wire 10 being inserted into the coupling portion 21 to close the cut 21*a*, the end of the core wire 11 is coupled to the coupling portion 21.

As shown in FIG. 4, by inserting a bolt 50 into the fastening hole 31 (see FIG. 1) of the complex terminal 30 and screwing the bolt 50 into a screw hole (not shown) of a fastening target 60, the two electric wires 10 are fastened to the fastening target 60 through the complex terminal 30.

Next, a process for manufacturing the complex terminal 30 from two existing connection terminals 20 will be described.

Figure 2:
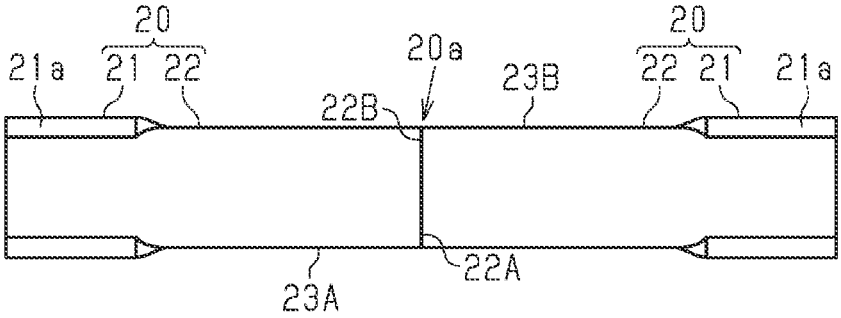
FIG. 2 is a plan view showing a state where end edges of two connection terminals are abutted against each other in a process for manufacturing the complex terminal in the embodiment.

As shown in FIG. 2, each connection terminal 20 has one coupling portion 21 having a U-shaped cross-section and one extending portion 22 extending from the coupling portion 21.

First, the abutment portion 20*a* is formed by abutting the end edges 22A and 22B of the extending portions 22 of the connection terminals 20 with each other.

Figure 3:
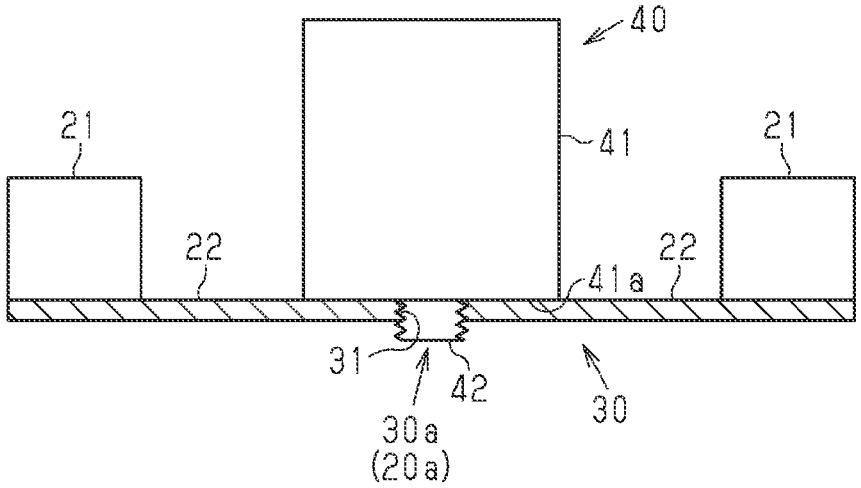
FIG. 3 is a cross-sectional view showing a state where an abutment portion of the two connection terminals is friction stir welded in the process for manufacturing the complex terminal in the embodiment.

Subsequently, as shown in FIG. 3, a friction stir welding tool 40 is pressed against a central portion in a width direction of the abutment portion 20*a* while being rotated. The tool 40 includes a columnar shoulder 41 that is rotationally driven by a drive unit (not shown), and a probe 42 that is provided projecting from the central portion of a lower surface 41*a* of the shoulder 41. The diameter of the shoulder 41 is larger than the width (length in a vertical direction in FIG. 2) of the extending portion 22 of the connection terminal 20. An outer peripheral surface of the probe 42 has protrusions and recessions.

Here, by pressing a tip of the rotating probe 42, frictional heat is generated in the abutment portion 20*a*, and the metal material forming the extending portion 22 is plastically fluidized at least partially so that a circular hole (hereinafter, the fastening hole 31) is formed.

Further, in the abutment portion 20*a*, in addition to the frictional heat generated by the outer peripheral surface of the rotating probe 42, frictional heat is generated by the lower surface 41*a* of the rotating shoulder 41. Thus, since the metal material forming the abutment portion 20*a* is plastically fluidized at least partially, the abutment portion 20*a* (edges 22A and 22B of the extending portions 22) is solid phase welded. Since the diameter of the shoulder 41 is larger than the width of the extending portion 22 of the connection terminal 20, the entirety in the width direction of the abutment portion 20*a* is joined.

Operation and effects of the present embodiment will be described.

(1) The fastening structure of the complex terminal 30 includes the two coupling portions 21 where the ends of the two electric wires 10 are respectively coupled, the two extending portions 22 respectively extending from the two coupling portions 21, and the joining portion 30*a* that is provided at the abutment portion 20*a* where the end edges 22A and 22B of the two extending portions 22 are abutted against each other, and is formed by friction stir welding. The fastening hole 31 formed by the tool 40 used in the friction stir welding is provided passing through the joining portion 30*a*.

According to such a configuration, the joining portion 30*a* formed by friction stir welding is provided at the abutment portion 20*a* where the end edges 22A and 22B of the extending portions 22 are abutted against each other. Therefore, the thickness of the joining portion 30*a* can be reduced as compared with, for example, a configuration in which a plurality of terminals are overlaid on each other in the thickness direction thereof. Further, since the fastening hole 31 formed by the tool 40 used in the friction stir welding is provided passing through the joining portion 30*a*, a step of separately forming the fastening hole 31 can be omitted.

For example, in the case of a configuration in which the plurality of terminals are overlaid on each other in the thickness direction and fastened to the fastening target, adhesion between the terminals is likely to be insufficient, and contact resistance between the terminals is likely to increase.

In this regard, according to the above configuration, the abutment portion 20*a* of the extending portions 22 is plastically fluidized by the friction stir welding tool 40 so as to be solid phase welded. Therefore, an increase in contact resistance described above can be preferably avoided.

(2) The complex terminal 30 is formed by friction stir welding the existing connection terminals 20 to each other.

According to this configuration, when manufacturing the complex terminal 30, since it is only necessary to friction stir weld the existing connection terminals 20 to each other, it is not necessary to construct a new complex terminal capable of fastening the ends of the electric wires 10.

The present embodiment can be modified and implemented as follows. The present embodiment and the following modifications can be implemented in combination with each other within a technically consistent range.

In the first modification and the second modification shown in FIGS. 5 and 6 below, components the same as those of the above embodiment are denoted by the same reference numerals, and corresponding components are respectively denoted by reference numerals increased by "100" and "200", to omit duplicate description.

In the above embodiment, the end edges 22A and 22B of the connection terminals 20 are joined together; however, side edges 23A and 23B of the connection terminals 20 may be joined together by friction stir welding.

Figure 5:
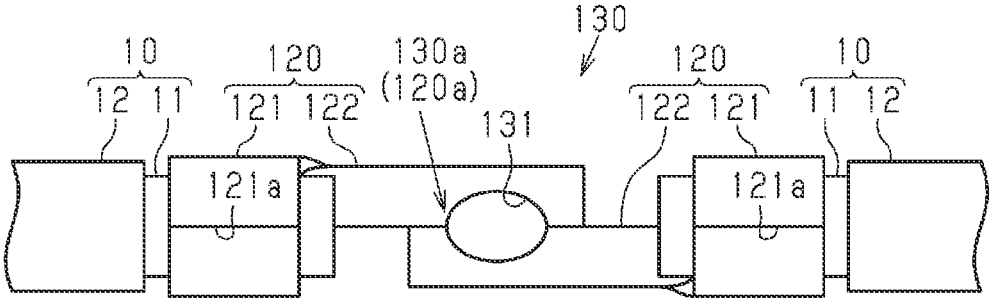
FIG. 5 is a plan view showing the complex terminal of a first modification.

In this case, for example, as shown in FIG. 5, a complex terminal 130 including a plurality of connection terminals 120 each having a coupling portion 121 and an extending portion 122 having a width approximately half the diameter of the coupling portion 121 can also be employed. According to the configuration, it is possible to suppress an increase in the physical size of the complex terminal 130 in the width direction as compared with a configuration in which the side edges 23A and 23B of the connection terminals 20 are joined together.

Figure 6:
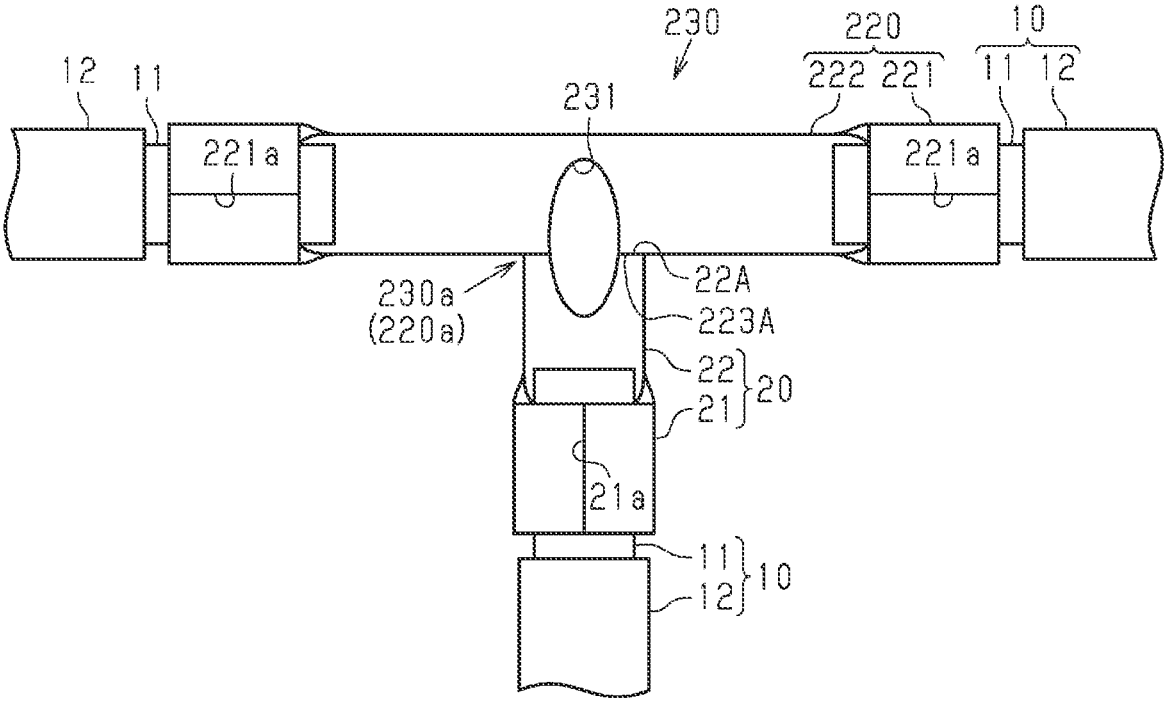
FIG. 6 is a plan view showing the complex terminal of a second modification.

As shown in FIG. 6, in a connection terminal 220 having two coupling portions 221 where the core wires 11 of the two electric wires 10 are coupled at the two ends of an extending portion 222 extending linearly, the end edge 22A of the connection terminal 20 may be abutted against a side edge 223A of the extending portion 222 and friction stir welded thereto.

As shown in FIGS. 5 and 6, fastening holes 131 and 231 may have an oval shape or an elliptical shape. According to this configuration, since the fastening hole 131 has an oval shape or an elliptical shape, manufacturing tolerances and assembly tolerances of the fastening hole 131 and a hole of the fastening target are easily absorbed by the fastening hole 131, and it is easy to insert a fastening member such as a bolt into the fastening holes 131 and 231 and the hole of the fastening target. Therefore, workability in fastening the complex terminals 130 and 230 to the fastening target can be improved.

In this case, the circular fastening hole formed by the friction stir welding tool 40 can also be enlarged into an oval shape or an elliptical shape by post-processing such as cutting.

One or more other connection terminals 20 may be abutted against side edges of the abutment portion 20*a*, and they may also be friction stir welded.

Whether the joining portions (30*a*, 130*a*, 230*a*) have been joined by friction stir welding can be identified, for example, by a metallographic analysis method such as microscopic observation, but there is no limitation to this.

Each coupling portion can be formed, for example, as a barrel portion.

Each extending portion can be formed, for example, as a conductive metal flat plate. Each extending portion can have a predetermined length, a constant width, and a constant plate thickness.

The present disclosure includes the following implementation examples. Reference numerals of representative components of the representative embodiment are provided not for limitation, but rather as an aid for understanding.

[Appendix 1] A complex terminal (30) according to a non-limiting embodiment includes:

a first metal plate (20) having at least one first barrel portion (21); and a second metal plate (20) having at least one second barrel portion (21), wherein the first metal plate (20) has a first end surface at a position different from the at least one first barrel portion (21), the second metal plate (20) has a second end surface at a position different from the at least one second barrel portion (21), the first end surface of the first metal plate (20) is abutted against the second end surface of the second metal plate (20), the first end surface and the second end surface that are abutted to each other and joined together by friction stir welding to form a friction stir welding portion (20*a*), and a through-hole (31) for inserting a bolt (50) for fastening the complex terminal (30) to a fastening target (60) is defined crossing a boundary between the first end surface and the second end surface that are abutted against each other.

[Appendix 2] In some implementation examples, the first metal plate (20) may be a first flat plate having a constant first plate thickness except in the at least one first barrel portion, the second metal plate (20) may be a second flat plate having a constant second plate thickness except in the at least one second barrel portion, and the first plate thickness may be equal to the second plate thickness.

[Appendix 3] The first metal plate (20) and the second metal plate (20) may form a continuous surface that substantially does not have a step in a plate thickness direction or a height step in the friction stir welding portion (20*a*).

[Appendix 4] In some implementation examples, the first metal plate (20) and the second metal plate (20) may not be overlaid on each other in the plate thickness direction.

[Appendix 5] In some implementation examples, the entirety of one of the first end surface of the first metal plate (20) and the second end surface of the second metal plate (20) may be joined to the other one of the first end surface of the first metal plate (20) and the second end surface of the second metal plate (20).

[Appendix 6] In some implementation examples, the entirety of the first end surface of the first metal plate (20) may be joined to the second end surface of the second metal plate (20).

[Appendix 7] In some implementation examples, a part of the first end surface of the first metal plate (20) may be joined to a part of the second end surface of the second metal plate (20).

[Appendix 8] In some implementation examples, the first metal plate (20) may be a first elongated plate having a length, the first barrel portion (21) may be formed at a base end of the first elongated plate, the first end surface may be a leading end surface of the first elongated plate, the second metal plate (20) may be a second elongated plate having a length, the second barrel portion (21) may be formed at a base end of the second elongated plate, and the second end surface may be a leading end surface of the second elongated plate.

[Appendix 9] In some implementation examples, the first metal plate (20) may be a first straight plate having a base end, a leading end, and a first side end surface extending between the base end and the leading end, the first barrel portion (21) may be formed at the base end of the first straight plate, and the first end surface may be a first side end surface portion having a predetermined length on the first side end surface of the first straight plate, and the second metal plate (20) may be a second straight plate having a base end, a leading end, and a second side end surface extending between the base end and the leading end, the second barrel portion (21) may be formed at the base end of the second straight plate, and the second end surface may be a second side end surface portion having a predetermined length on the second side end surface of the second straight plate.

[Appendix 10] In some implementation examples, the first metal plate (20) may be a first straight plate, the first barrel portion (21) may be formed at the base end of the first straight plate, and the first end surface may be the leading end surface of the first straight plate, and the second metal plate (20) may be a second straight plate having a base end, a leading end, and a second side end surface extending between the base end and the leading end, the at least one second barrel (21) may be a plurality of second barrel portions (21, 221) respectively formed at the base end and the leading end of the second straight plate, and the second end surface may be a second side end surface portion having a predetermined length on the second side end surface of the second straight plate.

It will be apparent to those skilled in the art that the present disclosure may be embodied in other specific forms without departing from a technical idea of the present disclosure. For example, some of the components described in the embodiment (or one or more aspects thereof) may be omitted, or some components may be combined. The scope of the present disclosure should be determined with reference to the appended claims, along with the full scope of equivalents to which the claims are entitled.

The invention claimed is:

1. A complex terminal with a fastening structure for collectively fastening ends of a plurality of electric wires to a fastening target, the complex terminal comprising:

a plurality of couplers to which the ends of the plurality of electric wires are to be respectively coupled;

a plurality of extensions respectively extending from the plurality of couplers; and a solid phase welded joint attaching a first edge surface of a first extension of the plurality of extensions and a second edge surface of a second extension of the plurality of extensions where the first edge surface of the first extension and the second edge surface of the second extension abut each other;

wherein a fastening hole is formed passing through the joint.

2. The complex terminal according to claim 1, wherein the fastening hole has an oval shape or an elliptical shape.

* * * * *